US010679593B2

(12) United States Patent
Destocki

(10) Patent No.: US 10,679,593 B2
(45) Date of Patent: Jun. 9, 2020

(54) MODULAR PERCUSSION INSTRUMENT DEVICE AND METHOD

(71) Applicant: Robert Destocki, Moorpark, CA (US)

(72) Inventor: Robert Destocki, Moorpark, CA (US)

( * ) Notice: Subject to any disclaimer, the term of this patent is extended or adjusted under 35 U.S.C. 154(b) by 0 days.

(21) Appl. No.: 16/050,812

(22) Filed: Jul. 31, 2018

(65) Prior Publication Data

US 2020/0043451 A1 Feb. 6, 2020

(51) Int. Cl.

| | |
|---|---|
| ***G10D 15/00*** | (2006.01) |
| ***G10D 13/06*** | (2020.01) |
| ***G10D 13/12*** | (2020.01) |

(52) U.S. Cl.

CPC ..... *G10D 15/00* (2013.01); *G10D 13/06* (2013.01); *G10D 13/12* (2020.02)

(58) Field of Classification Search

CPC ..... G10D 15/00; G10D 13/003; G10D 13/06; G10G 1/02

See application file for complete search history.

(56) References Cited

U.S. PATENT DOCUMENTS 9,837,057 B1 * 12/2017 Jespersen ..... G10D 13/06
2016/0196813 A1 * 7/2016 Hardi ..... G10H 1/0008 84/600

FOREIGN PATENT DOCUMENTS

KR 20190054003 A * 5/2019 ..... G10G 1/02

* cited by examiner

*Primary Examiner* — Kimberly R Lockett

(57) ABSTRACT

The embodiments disclose at least one modular percussion instrument configured for coupling two or more modular percussion instrument components into a single percussion instrument apparatus, wherein the two or more modular percussion instrument components include a beat tip, a tapered percussion instrument end, a rubber grommet retainer, a modular shaker section, a percussion instrument butt end, a felt mallet module, a plurality of steel shot, grouped rods, at least one grouped rods jacket, a butt end grouped rods cap and modular percussion instrument electronic devices and a modular percussion instrument application configured to create modular percussion instrument application connectivity to digital devices, wherein the at least one modular percussion instrument is configured for assisting a musician user to perform percussion instrumentals without having to physically switch equipment and as a teaching apparatus.

20 Claims, 9 Drawing Sheets

MODULAR PERCUSSION INSTRUMENT DEVICE AND METHOD

BACKGROUND

Percussion instruments include different types for beating a drum skin, others have soft tip ends to create softer muffled sounds, and musicians most frequently are the percussion section of smaller bands and use maracas or other instruments to create percussion sounds. The difficulty for a musician is to switch between the various percussion instrument types.

DETAILED DESCRIPTION OF THE INVENTION

In a following description, reference is made to the accompanying drawings, which form a part hereof, and in which is shown by way of illustration a specific example in which the invention may be practiced. It is to be understood that other embodiments may be utilized and structural changes may be made without departing from the scope of the present invention.

General Overview:

It should be noted that the descriptions that follow, for example, in terms of a modular percussion instrument method and devices is described for illustrative purposes and the underlying system can apply to any number and multiple types of percussion instrument configurations. In one embodiment of the present invention, a modular percussion instrument method and devices can include a traditional percussion instrument tip terminus of a tapered section of a percussion instrument shaft and a felt mallet tip at the butt end of a percussion instrument shaft. The modular percussion instrument method and devices is a variable percussion instrument system and modular percussion instrument components which can be configured with a modular shaker located along the percussion instrument shaft near the front end tip and at the butt end of the percussion instrument shaft, and in other forms, colors, combinations, elements, shapes and sizes using the present invention.

The term modular as herein utilized refers to the various components and applies to the components even when the term modular is not present.

Figure 1:
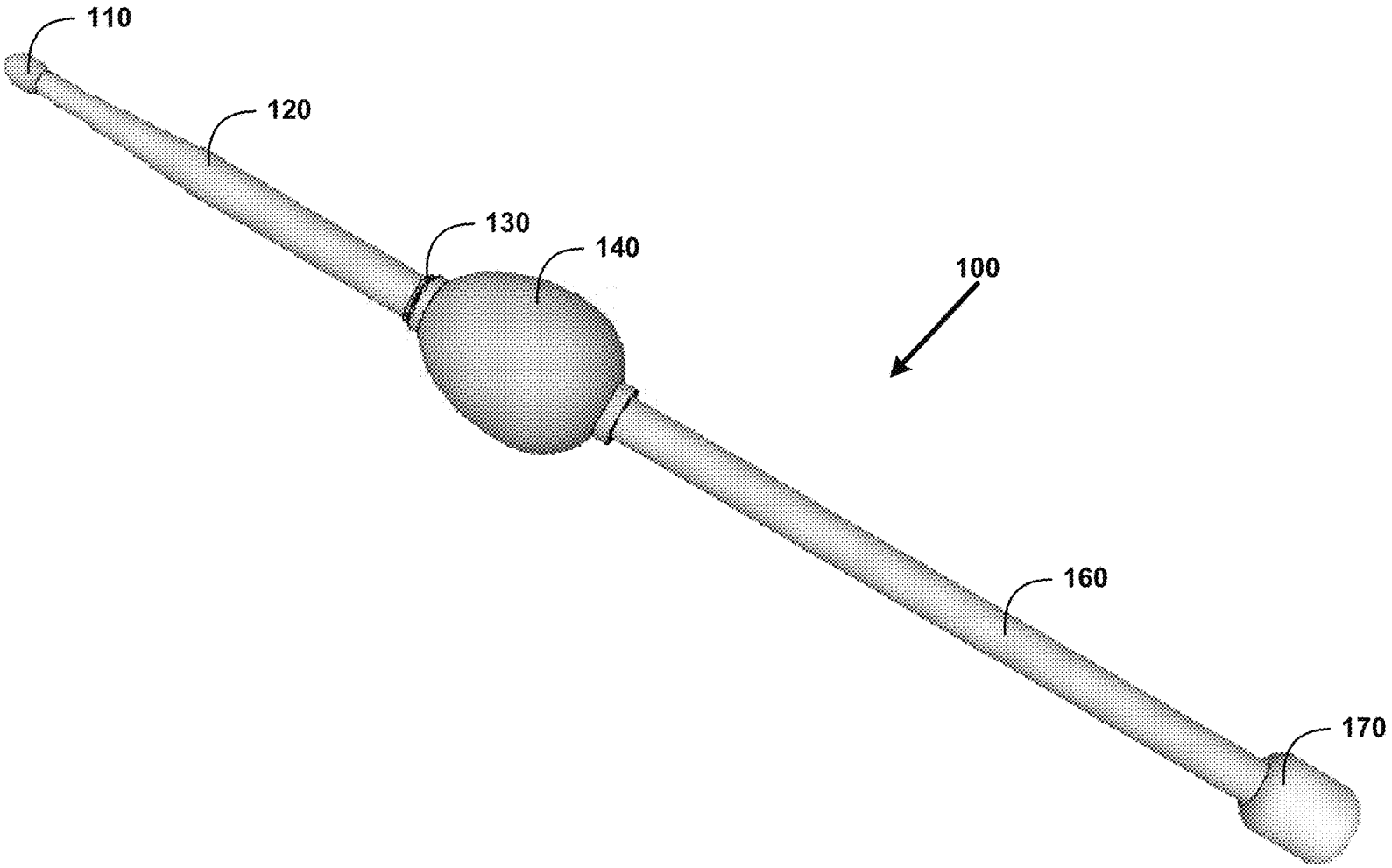
FIG. 1 shows for illustrative purposes only an example of a modular percussion instrument of one embodiment.

FIG. 1 shows for illustrative purposes only an example of a modular percussion instrument of one embodiment. FIG. 1 shows a modular percussion instrument 100 with a beat tip 110 at one terminus of a tapered percussion instrument end 120. Creating at least one modular percussion instrument 100 includes creating at least two modular percussion instrument components. The modular percussion instrument 100 includes a rubber grommet retainer 130 used to prevent a shaker section 140 from sliding up the tapered percussion instrument as a musician plays with the modular percussion instrument 100 version of a modular percussion instrument. The modular percussion instrument 100 includes at a percussion instrument butt end 160 a felt mallet 170 for producing a softer sound when striking a cymbal or other percussion instrument of one embodiment.

DETAILED DESCRIPTION

Figure 2A:
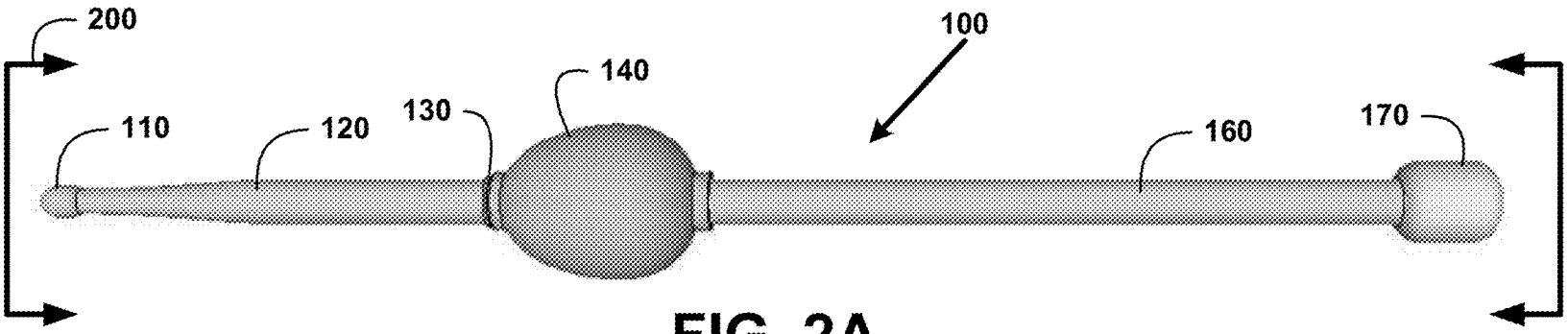
FIG. 2A shows for illustrative purposes only an example of a modular percussion instrument cross section selection of one embodiment.

FIG. 2A shows for illustrative purposes only an example of a modular percussion instrument cross section selection of one embodiment. FIG. 2A shows the modular percussion instrument 100 with the beat tip 110, tapered percussion instrument end 120, rubber grommet retainer 130, shaker section 140, percussion instrument butt end 160 and felt mallet 170 of one embodiment. Also shown is a cross section selection 200 used to indicate the area of a cross section shown in FIG. 2B.

Figure 2B:
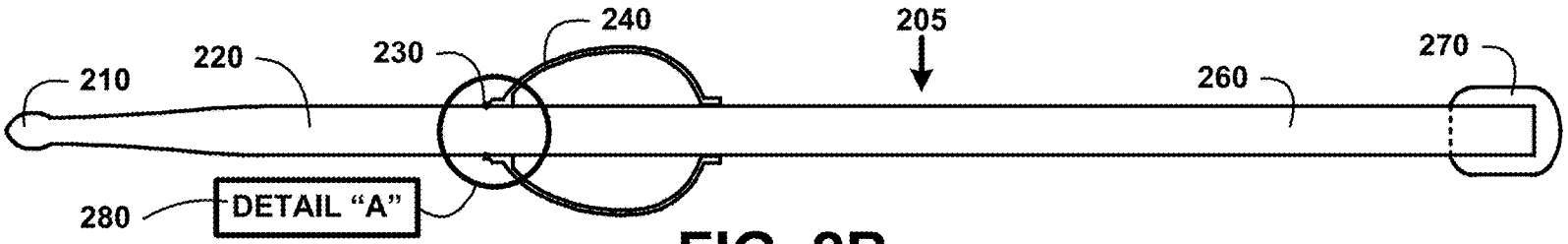
FIG. 2B shows for illustrative purposes only an example of a modular percussion instrument cross section view of one embodiment.

Modular Percussion Instrument Cross Section View:

FIG. 2B shows for illustrative purposes only an example of a modular percussion instrument cross section view of one embodiment. FIG. 2B shows a modular percussion instrument cross section 205 including a solid beat tip cross section 210, solid tapered percussion instrument end cross section 220, a rubber grommet retainer cross section 230, a shaker section cross section 240, a percussion instrument butt end cross section 260, and a felt mallet cross section 270. Also showing a Detail "A" 280 which includes a section of the solid tapered percussion instrument end cross section 220, the rubber grommet retainer cross section 230, and the shaker section cross section 240 of one embodiment.

Figure 2G:
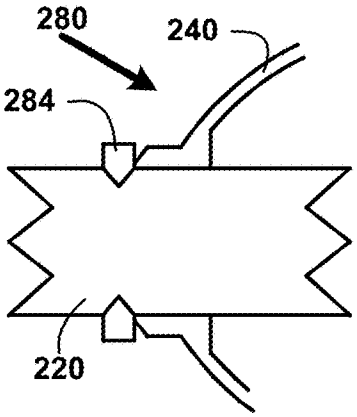
FIG. 2G shows for illustrative purposes only an example of a modular rubber grommet retaining a modular shaker Detail "A" of one embodiment.
Figure 2F:
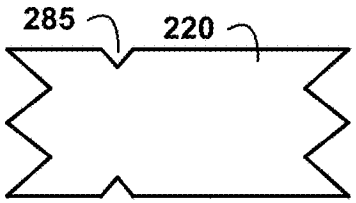
FIG. 2F shows for illustrative purposes only an example of a modular percussion instrument rubber grommet retainer groove of one embodiment.
Figure 2E:
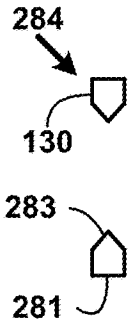
FIG. 2E shows for illustrative purposes only an example of a modular rubber grommet retainer cross section view of one embodiment.
Figure 2D:
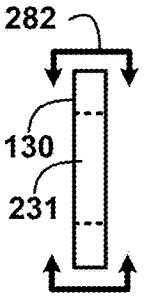
FIG. 2D shows for illustrative purposes only an example of a modular rubber grommet retainer cross section selection of one embodiment.
Figure 2C:
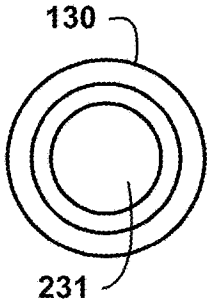
FIG. 2C shows for illustrative purposes only an example of a modular rubber grommet retainer of one embodiment.

Rubber Grommet Retainer:

FIG. 2C shows for illustrative purposes only an example of a modular rubber grommet retainer of one embodiment. FIG. 2C shows the rubber grommet retainer 130 including the center opening 231 used to slide the rubber grommet retainer 130 over the percussion instrument shaft of one embodiment.

Rubber Grommet Retainer Cross Section Selection:

FIG. 2D shows for illustrative purposes only an example of a modular rubber grommet retainer cross section selection of one embodiment. FIG. 2D shows a rubber grommet retainer 130 end view cross section selection 282 showing the center opening 231 of one embodiment.

Rubber Grommet Retainer Cross Section View:

FIG. 2E shows for illustrative purposes only an example of a modular rubber grommet retainer cross section view of one embodiment. FIG. 2E shows a rubber grommet retainer 130 cross section view 284 showing a central "V" shaped section 283 corresponding to a retainer groove in the solid tapered percussion instrument end cross section 220 of FIG. 2B and a square shaped outer section 281 of one embodiment.

Percussion Instrument Rubber Grommet Retainer Groove:

FIG. 2F shows for illustrative purposes only an example of a modular percussion instrument rubber grommet retainer groove of one embodiment. FIG. 2F shows a percussion instrument rubber grommet retainer groove 285 cut into the solid tapered percussion instrument end cross section 220. The percussion instrument rubber grommet retainer groove 285 is used to seat the central "V" shaped section 283 of the rubber grommet retainer 130 of FIG. 1 and as shown in a rubber grommet retainer cross section view 284 of one embodiment.

Rubber Grommet Retaining Shaker Detail "A":

FIG. 2G shows for illustrative purposes only an example of a modular rubber grommet retaining a modular shaker Detail "A" of one embodiment. FIG. 2G shows a modular rubber grommet retaining a modular shaker Detail "A" 280 including the tapered percussion instrument end cross section 220, shaker section cross section 240 and the rubber grommet retainer cross section view 284 positioned seated in the percussion instrument rubber grommet retainer groove 285 of FIG. 2F to prevent the shaker from sliding up the tapered percussion instrument end 120 of FIG. 1 of one embodiment.

Figure 3C:
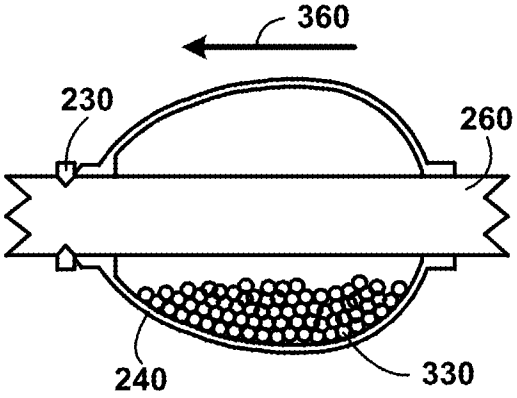
FIG. 3C shows for illustrative purposes only an example of a modular shaker section with steel shot loaded of one embodiment.
Figure 3B:
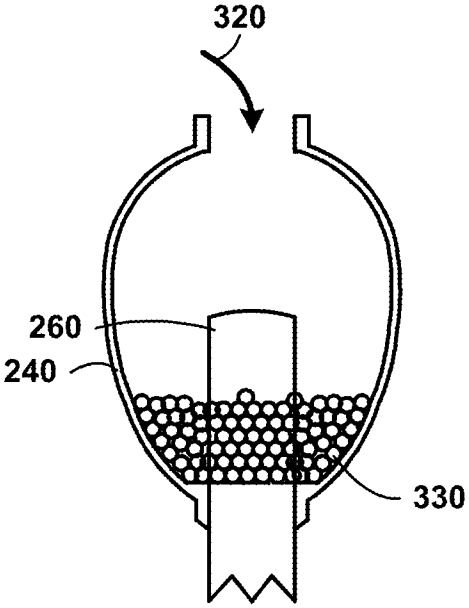
FIG. 3B shows for illustrative purposes only an example of a cross section of a modular shaker section of one embodiment.
Figure 3A:
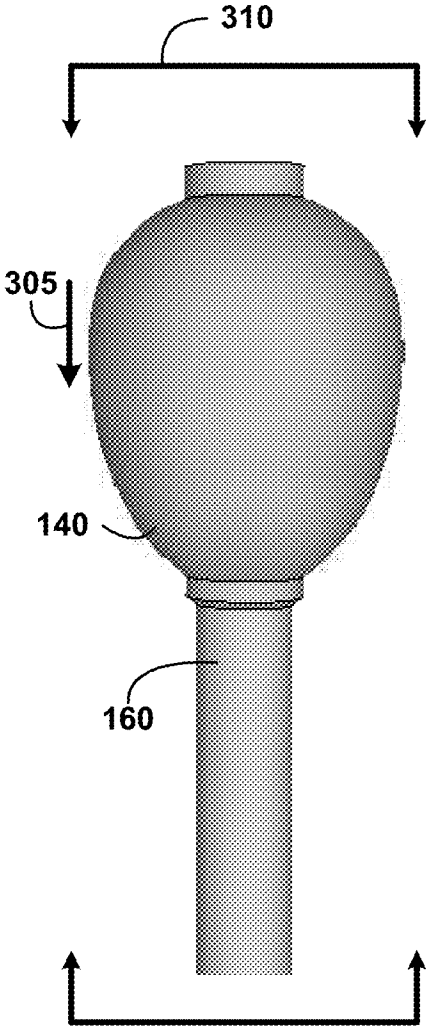
FIG. 3A shows for illustrative purposes only an example of a modular shaker retained on a modular percussion instrument of one embodiment.

Shaker Retained on Percussion Instrument:

FIG. 3A shows for illustrative purposes only an example of a modular shaker retained on a modular percussion instrument of one embodiment. FIG. 3A shows a modular shaker section 140 partially slid 305 down a modular percussion instrument butt end 160. Also shown are cross section indicators 310 of the cross section shown in FIG. 3B of one embodiment.

Loading Steel Shot into Shaker:

FIG. 3B shows for illustrative purposes only an example of a cross section of a modular shaker section of one embodiment. FIG. 3B shows a cross section of a modular shaker section 240 partial lid onto cross section of a modular percussion instrument butt end 260 leaving one end open. While opened a process is performed for placing a plurality of steel shot 330 in the shaker section 320 of one embodiment.

Shaker Holding Steel Shot:

FIG. 3C shows for illustrative purposes only an example of a modular shaker section with steel shot loaded of one embodiment. FIG. 3C shows a cross section of the modular shaker section 240 loaded with the plurality of steel shot 330 and slid fully 360 onto the modular percussion instrument butt end 260. Sliding the modular shaker section 240 loaded with the plurality of steel shot 330 fully onto the modular percussion instrument butt end 260 closes the open end of the modular shaker section 240 to prevent the steel shot from falling out. The modular shaker section 240 is slid against the rubber grommet retainer cross section 230 to stop the modular shaker section 240 from sliding off the tapered percussion instrument end 120 of FIG. 1. The modular shaker section 240 loaded with the plurality of steel shot 330 can be used for producing a shaker sound with used. The shakers are egg shaped and can be made for example of High Density Polyethylene (HDPE) of one embodiment.

Figure 4A:
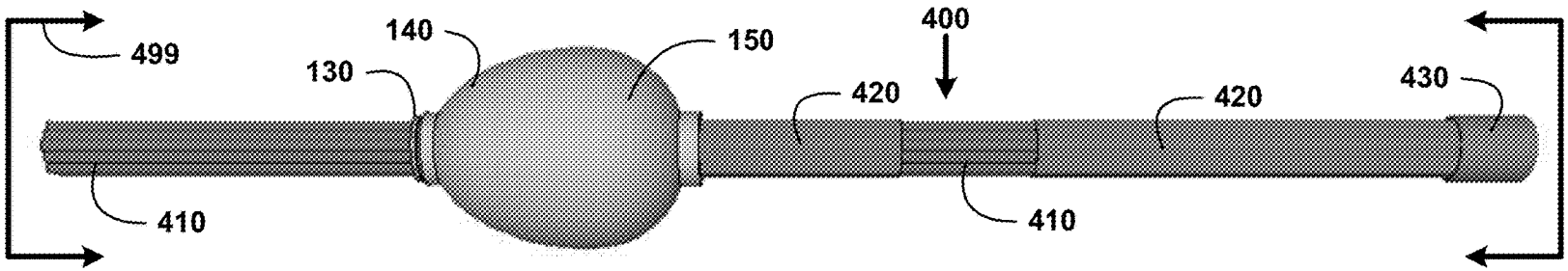
FIG. 4A shows for illustrative purposes only an example of a modular grouped rod percussion instrument cross section selection of one embodiment.

Modular Grouped Rod Percussion Instrument Cross Section Selection:

FIG. 4A shows for illustrative purposes only an example of a modular grouped rod percussion instrument cross section selection of one embodiment. FIG. 4A shows a modular grouped rod percussion instrument cross section selection 499. A modular grouped rod percussion instrument 400 includes the rubber grommet retainer 130, shaker section 140, and grouped rods 410. Shown towards the butt end of the modular grouped rod percussion instrument 400 past the shaker are two sections of a grouped rods jacket 420 holding in place the grouped rods 410. A butt end grouped rods cap 430 is shown slid over the grouped rods jacket 420 and butt ends of the grouped rods 410 of one embodiment.

Figure 4B:
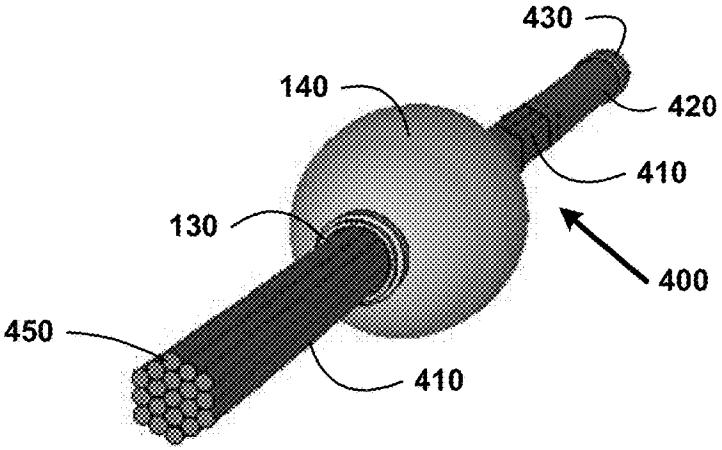
FIG. 4B shows for illustrative purposes only an example of a modular grouped rod percussion instrument end view of one embodiment.

Grouped Rod Percussion Instrument End View:

FIG. 4B shows for illustrative purposes only an example of a modular grouped rod percussion instrument end view of one embodiment. FIG. 4B shows a prospective view of the modular grouped rod percussion instrument 400, rubber grommet retainer 130, shaker section 140, grouped rods 410, grouped rods jacket 420, and butt end grouped rods cap 430. An end view of the grouped rods 410 shows one rod 450 of the grouped rods 410. Each rod can be cylindrically shaped and made of a variety of woods and other materials of one embodiment.

Figure 4C:
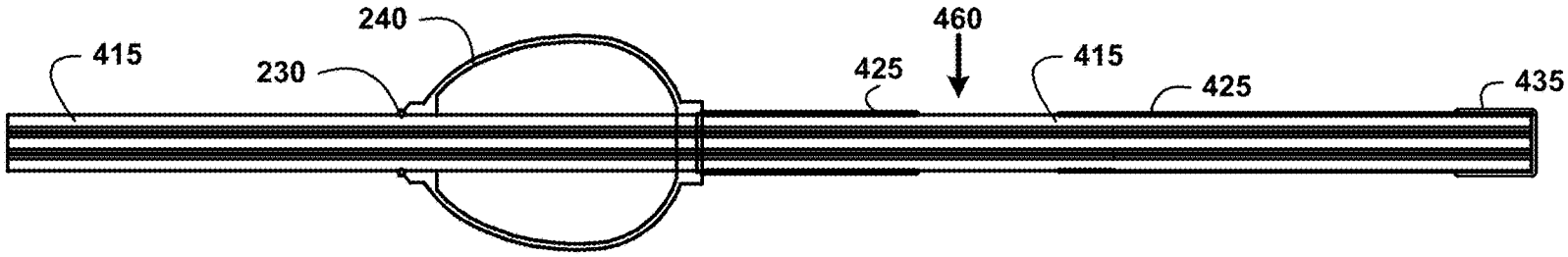
FIG. 4C shows for illustrative purposes only an example of a modular grouped rod percussion instrument cross section view of one embodiment.

Modular Grouped Rod Percussion Instrument Cross Section View:

FIG. 4C shows for illustrative purposes only an example of a modular grouped rod percussion instrument cross section view of one embodiment. FIG. 4C shows a modular grouped rod percussion instrument cross section view 460 including the rubber grommet retainer cross section 230, and shaker section cross section 240. Also shown are a grouped rods cross section 415, grouped rods jacket cross section 425 and a butt end grouped rods cap cross section 435 of one embodiment.

Figure 5A:
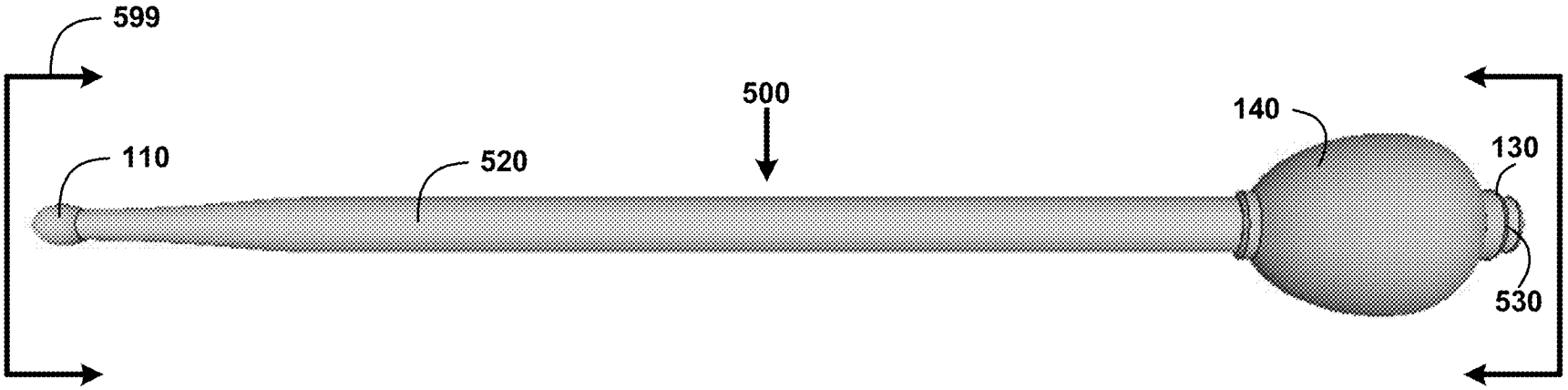
FIG. 5A shows for illustrative purposes only an example of a modular butt end shaker percussion instrument cross section selection of one embodiment.

Modular Butt End Shaker Percussion Instrument Cross Section Selection:

FIG. 5A shows for illustrative purposes only an example of a modular butt end shaker percussion instrument cross section selection of one embodiment. FIG. 5A shows a modular butt end shaker percussion instrument 500 including the beat tip 110, an extended tapered percussion instrument 520, the rubber grommet retainer 130, shaker section 140, and a shortened percussion instrument butt end 530. A modular butt end shaker percussion instrument cross section selection 599 is also shown of one embodiment.

Figure 5B:
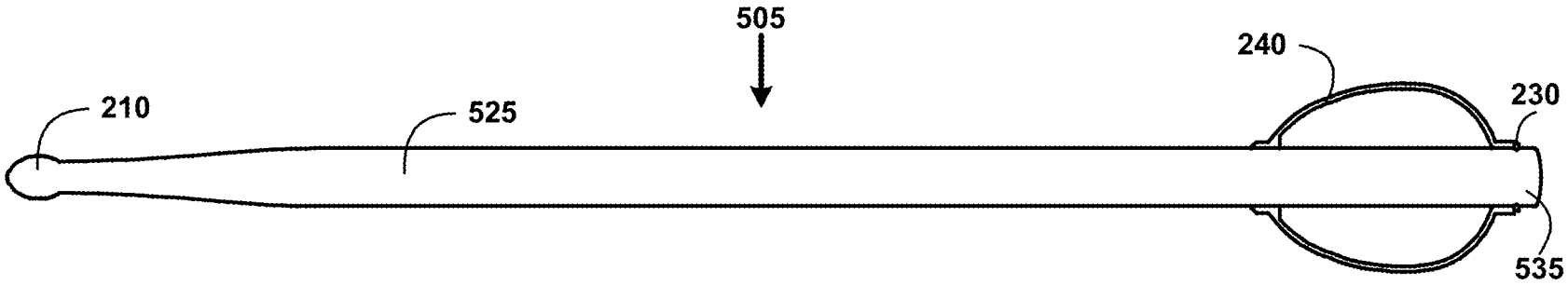
FIG. 5B shows for illustrative purposes only an example of a modular butt end shaker percussion instrument cross section view of one embodiment.

Modular Butt End Shaker Percussion Instrument Cross Section View:

FIG. 5B shows for illustrative purposes only an example of a modular butt end shaker percussion instrument cross section view of one embodiment. FIG. 5B shows a modular butt end shaker percussion instrument cross section 505. The cross section view shows the beat tip cross section 210, an extended tapered percussion instrument cross section 525, the rubber grommet retainer cross section 230, the shaker section cross section 240, and a shortened percussion instrument butt end cross section 535 of one embodiment.

Figure 6A:
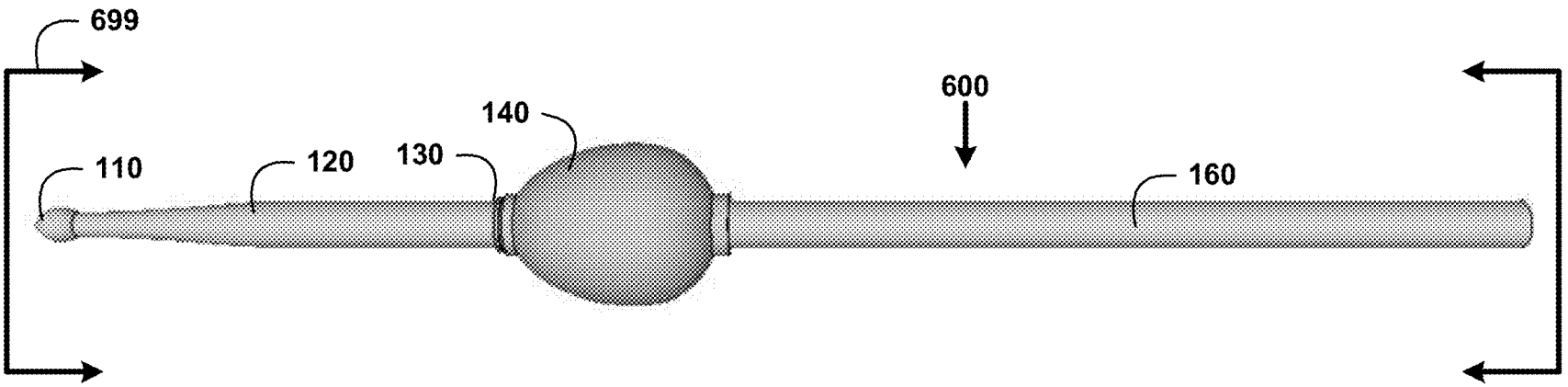
FIG. 6A shows for illustrative purposes only an example of a modular percussion instrument cross section selection of one embodiment.

Modular Percussion Instrument Cross Section Selection:

FIG. 6A shows for illustrative purposes only an example of a modular percussion instrument cross section selection of one embodiment. FIG. 6A shows a modular percussion instrument 600 configured to include the beat tip 110, tapered percussion instrument end 120, rubber grommet retainer 130, shaker section 140, and the percussion instrument butt end 160. Also shown is a modular percussion instrument cross section selection 699 of one embodiment.

Figure 6B:
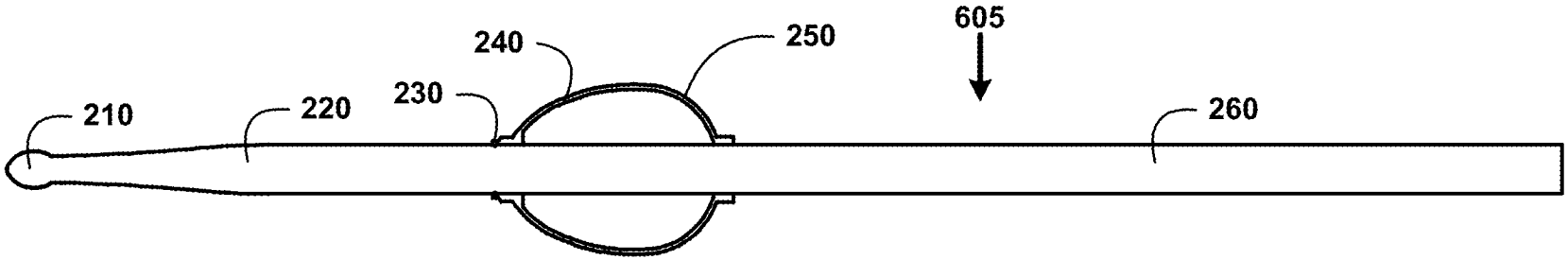
FIG. 6B shows for illustrative purposes only an example of a modular percussion instrument cross section view of one embodiment.

Modular Percussion Instrument Cross Section View:

FIG. 6B shows for illustrative purposes only an example of a modular percussion instrument cross section view of one embodiment. FIG. 6B shows a modular percussion instrument cross section 605 including the tapered percussion instrument end cross section 210, tapered percussion instrument end cross section 220, rubber grommet retainer cross section 230, shaker section cross section 240, and modular percussion instrument butt end cross section 260 of one embodiment.

Figure 7A:
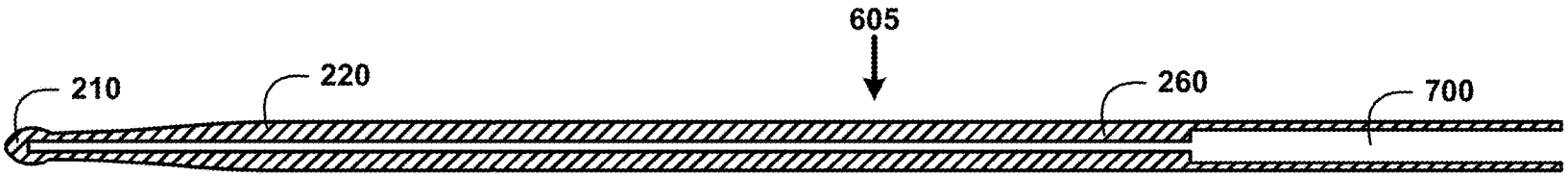
FIG. 7A shows for illustrative purposes only an example of a modular percussion instrument bored cavity of one embodiment.

A Modular Percussion Instrument Bored Cavity:

FIG. 7A shows for illustrative purposes only an example of a modular percussion instrument bored cavity of one embodiment. FIG. 7A shows the beat tip cross section 210, tapered percussion instrument end cross section 220, and percussion instrument butt end cross section 260 of the modular percussion instrument cross section 605. The modular percussion instrument 605 shows for example a percussion instrument bored cavity 700 that can be produced in at least one of the modular percussion instrument shafts. The percussion instrument bored cavity 700 can be for installing sensors, digital electronic devices and batteries within at least one of the modular percussion instrument shafts of one embodiment.

Figure 7B:
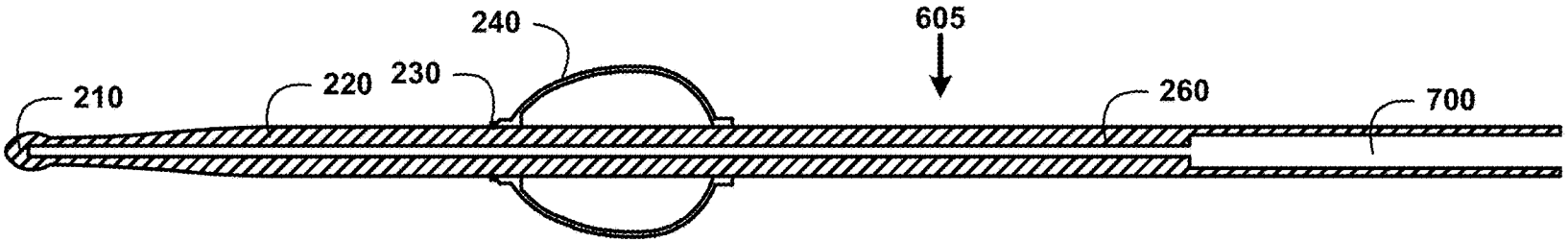
FIG. 7B shows for illustrative purposes only an example of a modular percussion instrument with a shaker and a bored cavity of one embodiment.

A Modular Percussion Instrument with a Shaker and a Bored Cavity:

FIG. 7B shows for illustrative purposes only an example of a modular percussion instrument with a shaker and a bored cavity of one embodiment. FIG. 7B shows the beat tip cross section 210, tapered percussion instrument end cross section 220, percussion instrument butt end cross section 260, and percussion instrument bored cavity 700 of the modular percussion instrument cross section 605 with a modular shaker installed. Showing are the rubber grommet retainer cross section 230, and shaker section cross section 240 of one embodiment.

Figure 8A:
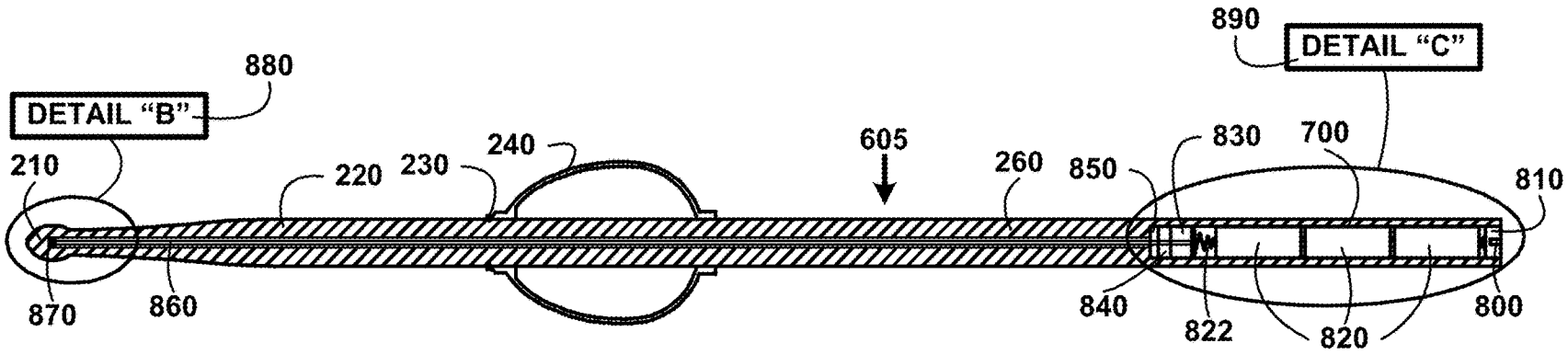
FIG. 8A shows for illustrative purposes only an example of a modular percussion instrument with electronic devices installed of one embodiment.

A Modular Percussion Instrument with Electronic Devices Installed:

FIG. 8A shows for illustrative purposes only an example of a modular percussion instrument with electronic devices installed of one embodiment. FIG. 8A shows the beat tip cross section 210, tapered percussion instrument end cross section 220, percussion instrument butt end cross section 260, and percussion instrument bored cavity 700 of the modular percussion instrument cross section 605 with a modular shaker installed. Showing are the rubber grommet retainer cross section 230, and shaker section cross section 240 of one embodiment.

FIG. 8A is also showing installed in the percussion instrument bored cavity 700 a percussion instrument cap 810 with a USB receptacle 800, a plurality of a batteries 820, and a battery spring 822. A digital processor and memory device 830 are installed to process and store sensor data and performance parameters including user selected pre-recorded music and a modular percussion instrument application. Additionally installed are a near-field transceiver 840, a tempo buzzer vibrator 850, circuitry cables 860 and a pressure sensor and tip tracking broadcast transmitter 870.

The pressure sensor measures the force of a modular percussion instrument tip striking for example a cymbal. The tip tracking broadcast transmitter broadcasts a tracking signal which is received by the near-field transceiver 840 wherein the digital processor and memory device 830 calculated a 3D position and movement speed of the beat tip in relationship to the modular percussion instrument butt end and stores that calculated data on digital memory of one embodiment.

FIG. 8A shows a Detail "B" 880 area selection including the beat tip of the modular percussion instrument. FIG. 8A also shows a Detail "C" 890 area selection at the butt end of the modular percussion instrument of one embodiment.

Figure 8C:
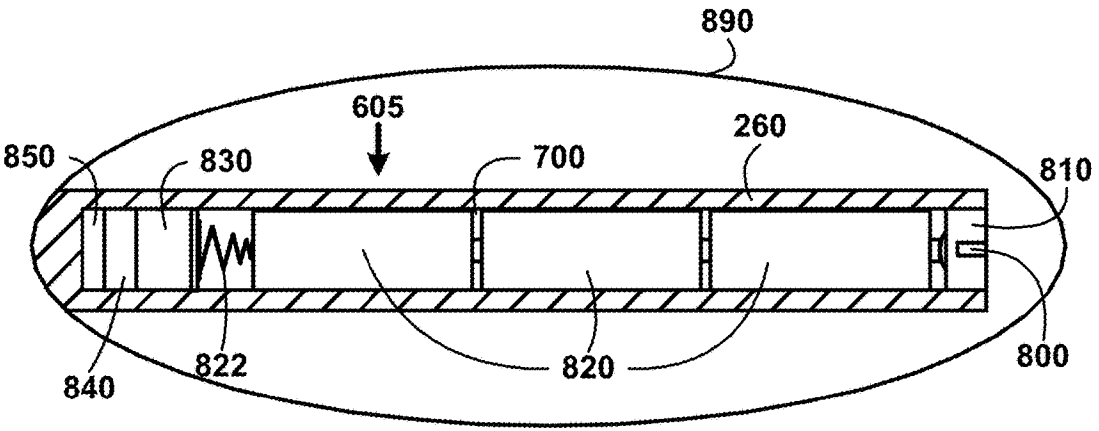
FIG. 8C shows for illustrative purposes only an example of a modular percussion instrument butt end electronic devices Detail of one embodiment.
Figure 8B:
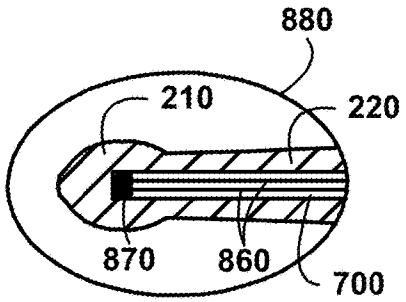
FIG. 8B shows for illustrative purposes only an example of a modular percussion instrument tip electronic devices Detail of one embodiment.

A Modular Percussion Instrument Tip Electronic Devices Detail:

FIG. 8B shows for illustrative purposes only an example of a modular percussion instrument tip electronic devices Detail of one embodiment. FIG. 8B shows the Detail "B" 880 area in greater detail including the beat tip cross section 210 and tapered percussion instrument end cross section 220. Showing in the percussion instrument bored cavity 700 are the circuitry cables 860 coupled to the pressure sensor and tip tracking broadcast transmitter 870 of one embodiment.

A Modular Percussion Instrument Butt End Electronic Devices Detail:

FIG. 8C shows for illustrative purposes only an example of a modular percussion instrument butt end electronic devices Detail of one embodiment. FIG. 8C shows the Detail "C" 890 area in greater detail including the modular percussion instrument cross section 605 including the percussion instrument butt end cross section 260, percussion instrument bored cavity 700, and the installed percussion instrument cap 810, USB receptacle 800, plurality of batteries 820, the battery spring 822, digital processor and memory device 830, near-field transceiver 840, the tempo buzzer vibrator 850 of one embodiment.

Figure 9:
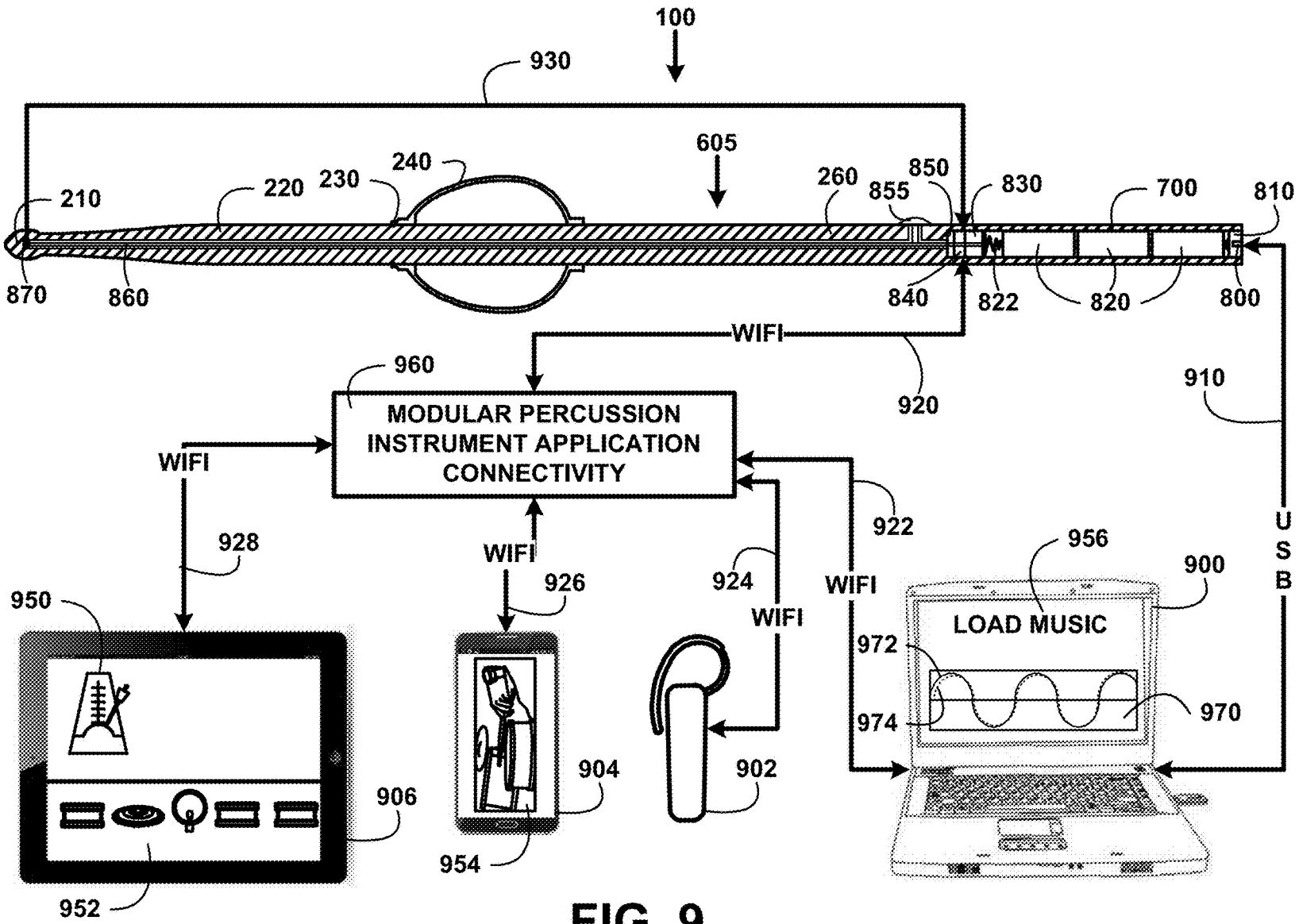
FIG. 9 shows for illustrative purposes only an example of a modular percussion instrument phone application connectivity overview of one embodiment.

A Modular Percussion Instrument Phone Application Connectivity Overview:

FIG. 9 shows for illustrative purposes only an example of a modular percussion instrument phone application connectivity overview of one embodiment. FIG. 9 shows the beat tip cross section 210, tapered percussion instrument end cross section 220, percussion instrument butt end cross section 260, modular percussion instrument cross section 605, percussion instrument bored cavity 700, rubber grommet retainer cross section 230, shaker section cross section 240, percussion instrument cap 810, USB receptacle 800, plurality of batteries 820, battery spring 822, digital processor and memory device 830, near-field transceiver 840, tempo buzzer vibrator 850, and a smart phone camera activation toggle switch 855 of one embodiment.

FIG. 9 also shows the circuitry cables 860 coupled to the pressure sensor and tip tracking broadcast transmitter 870 wherein the pressure sensor and tip tracking broadcast transmitter 870 are transmitting pressure and tip tracking 930 to the digital processor and memory device 830. The modular percussion instrument application can be installed in digital devices including computers including a laptop computer 900, hearing devices including a Bluetooth 902, a smart phone 904 and a tablet 906. The modular percussion instrument application connectivity 960 can be used with a laptop computer 900 to load music 956 into a percussion instrument memory device using a USB cable 910 connection to the USB receptacle 800. The near-field transceiver 840 can broadcast a WIFI signal using the modular percussion instrument application connectivity 960 of a modular percussion instrument application. The near-field transceiver 840 can broadcast WIFI signals 920 to musician user digital devices. A broadcast WIFI signal 922 can include a loaded music tempo graphical representation 972 and broadcast an overlapping musician tempo graphical representation 974 being performed using the modular percussion instrument 605 to assist the musician user with keeping a prerecorded tempo and/or beat 970. The modular percussion instrument application connectivity 960 can be used to transmit a metronome sound 928 and/or display 950 at the tempo of the downloaded music to a musician user digital device for example the tablet 906.

The modular percussion instrument application connectivity 960 can be used to remotely play music along with friends including for example other band members. The modular percussion instrument musician user can using the modular percussion instrument application connectivity 960 to a smart phone and/or a computer with a camera and speakers to broadcast the user's percussion instrumental of a song while in visual and audio contact with other musicians. Social media competitions can be arranged wherein musician users of the modular percussion instrument 100 of FIG. 1 with the modular percussion instrument application connectivity 960 can remotely participate in the competition.

The modular percussion instrument application connectivity 960 can create a teaching tool 952. For example, displaying sequentially which modular percussion instrument component should be used with the modular percussion instrument for the downloaded music to the musician user digital device display. A tempo and beat broadcast 924 by the modular percussion instrument near-field transceiver 840 can be heard on musician user digital hearing devices including a Bluetooth 902. The tempo buzzer vibrator 850 will buzz and/or vibrate the beat and/or tempo as selected by the user for the user to be felt in a hand holding the modular percussion instrument or heard on a hearing device. The modular percussion instrument user can press the smart phone camera activation toggle switch 855 and broadcast a WIFI signal 926 to a musician user smart phone camera to take a selfie photo or video 954 while playing a percussion instrumental using the modular percussion instrument.

In one embodiment a method includes creating at least one modular percussion instrument configured for coupling two or more modular percussion instrument components into a single percussion instrument apparatus, wherein the two or more modular percussion instrument components can include a beat tip, a tapered percussion instrument end, a rubber grommet retainer, a modular shaker section, a percussion instrument butt end, a felt mallet, a plurality of steel shot, grouped rods, at least one grouped rods jacket, modular percussion instrument electronic devices and a butt end grouped rods cap, creating modular percussion instrument application connectivity to digital devices is configured using a modular percussion instrument application, and wherein the at least one modular percussion instrument can be used by a user for performing percussion instrumentals without having to physically switch equipment and as a teaching apparatus.

Creating modular percussion instrument application connectivity to digital devices can be configured for broadcasting WIFI signals using a near-field transceiver for displaying music tempo and/or beat graphical representations of a user musical selection with music with an overlapping musician performance tempo graphical representation for assisting the musician user with keeping a prerecorded tempo and/or beat. Creating modular percussion instrument application connectivity to digital devices can be configured for transmitting a metronome sound and/or display of the downloaded music to a musician user digital device, for broadcasting an audio tempo and beat signal using a near-field transceiver can be heard on musician user digital hearing devices including a Bluetooth, for activating a tempo buzzer vibrator for producing a buzzing sound and/or vibration of a beat and/or tempo as selected by a user that the user can feel in a hand holding the modular percussion instrument or can hear on a hearing device.

Creating modular percussion instrument application connectivity to digital devices can be configured for broadcasting a teaching tool displaying a sequence of modular percussion instrument components to be used according to downloaded music to a musician user digital device display. Creating modular percussion instrument application connectivity to digital devices can be configured for downloading music into a percussion instrument memory device using a USB cable connection to a modular percussion instrument USB receptacle. Creating modular percussion instrument application connectivity to digital devices includes a modular percussion instrument application for digitally connecting the at least one modular percussion instrument to musician user digital devices with the modular percussion instrument application installed including a computer, a laptop computer, hearing devices including a Bluetooth, a smart phone, and a tablet. Installing modular percussion instrument electronic devices includes a percussion instrument cap with a USB receptacle, a plurality of a batteries, a battery spring, a digital processor, a memory device, a near-field transceiver, a tempo buzzer vibrator, a smart phone camera activation toggle switch, circuitry cables, a smart phone camera activation toggle switch, a pressure sensor and a tip tracking broadcast transmitter.

Creating modular percussion instrument application connectivity to digital devices for pressing a smart phone camera activation toggle switch for broadcasting a WIFI signal using a near-field transceiver to take the musician user smart phone camera to take a selfie photo or video while playing a percussion instrumental using the modular percussion instrument. The rubber grommet retainer is configured for sliding along the tapered percussion instrument end and seating in a modular percussion instrument rubber grommet retainer groove cut into the tapered percussion instrument end for preventing the modular shaker section from sliding towards the beat tip when being used to strike a cymbal or other percussion instrument. The rubber grommet retainer is configured for sliding along the percussion instrument butt end and seating in a modular percussion instrument rubber grommet retainer groove cut into the percussion instrument butt end for preventing the two section modular shaker from sliding towards the terminus of the percussion instrument butt end when being used in percussion instrumentals.

In another embodiment an apparatus includes at least one modular percussion instrument configured for coupling two or more modular percussion instrument components into a single percussion instrument apparatus, wherein the two or more modular percussion instrument components include a beat tip, a tapered percussion instrument end, a rubber grommet retainer, a modular shaker section, a percussion instrument butt end, a felt mallet module, a plurality of steel shot, grouped rods, at least one grouped rods jacket, a butt end grouped rods cap and modular percussion instrument electronic devices, a modular percussion instrument application configured to create modular percussion instrument application connectivity to digital devices, and wherein the at least one modular percussion instrument is configured for assisting a musician user to perform percussion instrumentals without having to physically switch equipment and as a teaching apparatus.

The modular percussion instrument electronic devices includes a USB receptacle, a plurality of a batteries, a battery spring, a digital processor, a memory device, a near-field transceiver, a tempo buzzer vibrator, a smart phone camera activation toggle switch, circuitry cables, a smart phone camera activation toggle switch, a pressure sensor and a tip tracking broadcast transmitter. The modular percussion instrument application is configured for installation and use on user digital devices including a computer, a laptop computer, hearing devices including a Bluetooth, a smart phone, and a tablet. The modular percussion instrument electronic devices are configured for WIFI broadcasting user selected music, tempo, and beat audibly, graphically on user digital devices and physically on the modular percussion instrument, and configured for downloading, storing and playing user selected music, and configured for 3D tracking of the modular percussion instrument beat tip, storing and displaying the 3D tracking data on a user digital device with the modular percussion instrument application installed.

The at least one modular percussion instrument can be configured to include the modular percussion instrument electronic devices including a smart phone camera activation toggle switch wherein a modular percussion instrument user can press the smart phone camera activation toggle switch and broadcast a WIFI signal using a near-field transceiver to activate a musician user smart phone camera to take a selfie photo or video while playing a percussion instrumental using the modular percussion instrument.

In yet another embodiment an apparatus includes at least one modular percussion instrument configured to include a combination of two or more modular percussion instrument components to create a single modular percussion instrument with multiple percussion musical capabilities, wherein the one or more modular percussion instrument components include a beat tip, a tapered percussion instrument end, a rubber grommet retainer, a modular shaker section configured to include a plurality of steel shot, a percussion instrument butt end, a felt mallet module, grouped rods, at least one grouped rods jacket, a butt end grouped rods cap, at least one modular percussion instrument electronic device, a modular percussion instrument application to create modular percussion instrument application connectivity to digital devices, and wherein the at least one modular percussion instrument can be used by a user for performing percussion instrumentals without having to physically switch equipment.

The at least one modular percussion instrument electronic device can be configured to include a USB receptacle, a plurality of a batteries, a battery spring, a digital processor, a memory device, a near-field transceiver, a tempo buzzer vibrator, a smart phone camera activation toggle switch, circuitry cables, a smart phone camera activation toggle switch, a pressure sensor and a tip tracking broadcast transmitter. The modular percussion instrument application is configured to create modular percussion instrument application connectivity to digital devices includes connectivity to a computer, a laptop computer, hearing devices including a Bluetooth, a smart phone, and a tablet. The rubber grommet retainer is configured to seat into a modular percussion instrument rubber grommet retainer groove cut into a percussion instrument shaft to prevent the modular shaker section from sliding along the percussion instrument shaft when being used.

The at least one modular percussion instrument electronic device can be configured for WIFI broadcasting user selected music, tempo, and beat audibly, graphically on user digital devices and physically on the modular percussion instrument, and configured for downloading, storing and playing user selected music, and configured for 3D tracking of the modular percussion instrument beat tip, storing and displaying the 3D tracking data on a user digital device with the modular percussion instrument application installed, and configured wherein a smart phone camera activation toggle switch can be pressed to broadcast a WIFI signal using a near-field transceiver to activate a musician user smart phone camera to take a selfie photo or video while playing a percussion instrumental using the modular percussion instrument.

The foregoing has described the principles, embodiments and modes of operation of the present invention. However, the invention should not be construed as being limited to the particular embodiments discussed. The above described embodiments should be regarded as illustrative rather than restrictive, and it should be appreciated that variations may be made in those embodiments by workers skilled in the art without departing from the scope of the present invention as defined by the following claims.

What is claimed is:

1. A method, comprising:

coupling two or more modular percussion instrument components into a single modular percussion instrument apparatus;

wherein the two or more modular percussion instrument components are selected from a group of modular percussion instrument components that includes a solid beat tip, a solid tapered percussion instrument, a rubber grommet retainer, a modular shaker section, a percussion instrument butt end, a felt mallet, a plurality of steel shot, grouped rods, at least one grouped rods jacket, a butt end grouped rods cap, modular percussion instrument electronic devices and a butt end grouped rods cap;

using a modular percussion instrument application for connectivity to the modular percussion instrument electronic devices configured for producing audible tempo and beat sounds and for producing tempo and beat vibrations, and for downloading, storing and broadcasting music using WIFI, and for 3D tracking of signals from the modular percussion instrument solid beat tip;

using the modular percussion instrument application for transmitting and receiving data to and from user digital devices and to and from modular percussion instrument electronic devices; and using the single modular percussion instrument apparatus by a user as a teaching apparatus for performing percussion instrumentals without having to physically switch equipment.

2. The method of claim 1, further comprising coupling at least one modular percussion instrument electronic device configured for WIFI broadcasting user selected music, tempo, and beat audibly and graphically on a user digital device and physically on the single modular percussion instrument using a tempo buzzer vibrator.

3. The method of claim 1, wherein at least one modular percussion instrument electronic device may include a near-field transceiver wherein the near-field transceiver is configured for broadcasting user selected tempo and beat signals to a tempo buzzer vibrator wherein the tempo buzzer vibrator uses the user selected tempo and beat signals received from the near-field transceiver to produce audible buzzing sounds corresponding to the tempo and beat a user can hear on a user hearing device.

4. The method of claim 1, further comprising broadcasting a teaching tool displaying a sequence of modular percussion instrument components to be used according to downloaded music to a musician user digital device display.

5. The method of claim 1, further comprising downloading music into a percussion instrument memory device using a USB cable connection to a modular percussion instrument USB receptacle.

6. The method of claim 1, further comprising coupling at least one coupled modular percussion instrument electronic device including a near-field transceiver configured for digitally connecting to user digital devices using the modular percussion instrument application installed in a computer, a laptop computer, a smart phone, a digital tablet, and configured for use in broadcasting music and musical elements including temp and beat audibly to user hearing devices including a Bluetooth, a smart phone, and a tablet.

7. The method of claim 1, further comprising coupling modular percussion instrument components selected from a group of modular percussion instrument components that includes a percussion instrument cap with a USB receptacle installed, a plurality of batteries, a battery spring, a digital processor, a memory device, a near-field transceiver, a tempo buzzer vibrator, a smart phone camera activation toggle switch, circuitry cables, a pressure sensor and a tip tracking broadcast transmitter.

8. The method of claim 1, further comprising coupling at least one modular percussion instrument component that includes a smart phone camera activation toggle switch configured for broadcasting a WIFI signal using a near-field transceiver to a musician's user smart phone camera to take a selfie photo or video while the user is playing a percussion instrumental using the modular percussion instrument.

9. The method of claim 1, further comprising using the rubber grommet retainer for sliding along the solid tapered percussion instrument and seating in a rubber grommet retainer groove cut into the solid tapered percussion instrument and is configured for preventing the modular shaker section from sliding towards and away from the solid beat tip.

10. The method of claim 1, further comprising coupling at least one modular percussion instrument electronic device including a tempo buzzer vibrator configured for receiving user selected tempo and beat signals from a near-field transceiver and wherein the tempo buzzer vibrator is configured for producing vibrations corresponding to the tempo and beat signals that can be felt by a user's hand holding the single modular percussion instrument apparatus.

11. An apparatus, comprising:

at least one modular percussion instrument configured for coupling two or more modular percussion instrument components into a single modular percussion instrument apparatus;

wherein the two or more modular percussion instrument components include a solid beat tip, a solid tapered percussion instrument, a rubber grommet retainer, a modular shaker section, a percussion instrument butt end, a felt mallet module, a plurality of steel shot, grouped rods, at least one grouped rods jacket, a butt end grouped rods cap and modular percussion instrument electronic devices;

a modular percussion instrument application configured to create modular percussion instrument application connectivity to digital devices; and wherein the at least one modular percussion instrument is configured for assisting a musician user to perform percussion instrumentals without having to physically switch equipment and as a teaching apparatus.

12. The apparatus of claim 11, wherein the modular percussion instrument electronic devices includes a USB receptacle, a plurality of a batteries, a battery spring, a digital processor, a memory device, a near-field transceiver, a tempo buzzer vibrator, a smart phone camera activation toggle switch, circuitry cables, a smart phone camera activation toggle switch, a pressure sensor and a tip tracking broadcast transmitter.

13. The apparatus of claim 11, wherein the modular percussion instrument application is configured for installation and use on user digital devices including a computer, a laptop computer, and hearing devices including a Bluetooth, a smart phone, and a tablet.

14. The apparatus of claim 11, wherein the modular percussion instrument electronic devices are configured for WIFI broadcasting user selected music, tempo, and beat audibly, graphically on user digital devices and physically on the modular percussion instrument, and configured for downloading, storing and playing user selected music, and configured for 3D tracking of the modular percussion instrument solid beat tip, storing and displaying the 3D tracking data on a user digital device with the modular percussion instrument application installed.

15. The apparatus of claim 11, further including a smart phone camera activation toggle switch wherein a modular percussion instrument user press the smart phone camera activation toggle switch for broadcasting a WIFI signal using a near-field transceiver to activate a musician user smart phone camera to take a selfie photo or video while the user is playing a percussion instrumental using the modular percussion instrument.

16. An apparatus, comprising:

at least one modular percussion instrument including a combination of two or more modular percussion instrument components to create a single modular percussion instrument with multiple percussion musical capabilities;

wherein the one or more modular percussion instrument components include a solid beat tip, a solid tapered percussion instrument, a rubber grommet retainer, a modular shaker section configured to include a plurality of steel shot, a percussion instrument butt end, a felt mallet module, grouped rods, at least one grouped rods jacket, a butt end grouped rods cap;

at least one modular percussion instrument electronic device;

a modular percussion instrument application to create modular percussion instrument application connectivity to digital devices; and wherein the at least one modular percussion instrument is used by a user for performing percussion instrumentals without having to physically switch equipment.

17. The apparatus of claim 16, wherein the at least one modular percussion instrument electronic device includes a USB receptacle, a plurality of batteries, a battery spring, a digital processor, a memory device, a near-field transceiver, a tempo buzzer vibrator, a smart phone camera activation toggle switch, circuitry cables, a pressure sensor and a tip tracking broadcast transmitter.

18. The apparatus of claim 16, wherein the modular percussion instrument application is configured to create modular percussion instrument application connectivity to digital devices includes connectivity to a computer, a laptop computer, and hearing devices including a Bluetooth, a smart phone, and a tablet.

19. The apparatus of claim 16, wherein the rubber grommet retainer is configured to seat into a modular percussion instrument rubber grommet retainer groove cut into a solid percussion instrument shaft to prevent the modular shaker section from sliding along the solid percussion instrument shaft when being used.

20. The apparatus of claim 16, wherein the at least one modular percussion instrument electronic device is configured for WIFI broadcasting user selected music, tempo, and beat audibly, graphically on user digital devices and physically on the modular percussion instrument, and configured for downloading, storing and playing user selected music, and configured for 3D tracking of the modular percussion instrument beat tip, storing and displaying the 3D tracking data on a user digital device with the modular percussion instrument application installed, and configured wherein a smart phone camera activation toggle switch may be pressed to broadcast a WIFI signal using a near-field transceiver to activate a musician user smart phone camera to take a selfie photo or video while a user is playing a percussion instrumental using the at least one modular percussion instrument.

* * * * *